US008091485B2

(12) United States Patent
Khairnar et al.

(10) Patent No.: US 8,091,485 B2
(45) Date of Patent: Jan. 10, 2012

(54) LOCOMOTIVE CAR BODY FLEXIBLE JOINT

(75) Inventors: Yogesh D. Khairnar, Chicago, IL (US); Butchi Babu Nalluri, Naperville, IL (US); Robert Thomas Scott, Shorewood, IL (US); Xiaokun Liu, Naperville, IL (US)

(73) Assignee: Electro-motive Diesel, Inc., LaGrange, IL (US)

( * ) Notice: Subject to any disclaimer, the term of this patent is extended or adjusted under 35 U.S.C. 154(b) by 0 days.

(21) Appl. No.: 12/181,573

(22) Filed: Jul. 29, 2008

(65) Prior Publication Data

US 2010/0024679 A1 Feb. 4, 2010

(51) Int. Cl.
*B61D 25/00* (2006.01)

(52) U.S. Cl. ..... 105/396; 105/404; 105/355

(58) Field of Classification Search ..... 105/197.05, 105/198.2, 198.4, 199.2, 199.3, 200, 355, 105/375, 411, 422, 456
See application file for complete search history.

(56) References Cited

U.S. PATENT DOCUMENTS

| | | | | |
|---|---|---|---|---|
| 1,298,194 | A * | 3/1919 | Frick et al. | 105/34.1 |
| 1,437,078 | A * | 11/1922 | Shepard | 105/456 |
| 5,088,417 | A * | 2/1992 | Richmond et al. | 105/411 |
| 5,794,536 | A * | 8/1998 | Daugherty et al. | 105/3 |
| 6,199,486 | B1 * | 3/2001 | Landrum et al. | 105/396 |
| 6,324,996 | B1 * | 12/2001 | Saxton et al. | 105/355 |
| 6,431,085 | B1 * | 8/2002 | Saxton et al. | 105/355 |
| 6,494,146 | B1 * | 12/2002 | Landrum et al. | 105/355 |
| 6,523,484 | B2 * | 2/2003 | Saxton et al. | 105/404 |
| 6,604,470 | B1 * | 8/2003 | Forbes | 105/355 |
| 6,647,895 | B2 * | 11/2003 | Saxton et al. | 105/355 |
| 6,659,017 | B2 * | 12/2003 | Forbes | 105/404 |
| 6,709,207 | B1 * | 3/2004 | Forbes | 410/32 |
| 6,883,437 | B2 * | 4/2005 | Saxton et al. | 105/355 |
| 6,920,829 | B2 * | 7/2005 | Forbes et al. | 105/355 |

(Continued)

FOREIGN PATENT DOCUMENTS

WO WO 2008/064221 A2 5/2008

OTHER PUBLICATIONS

Patent Cooperation Treaty; From: International Searching Authority; PCT/US2009/050924; Notification of Transmittal of the International Search Report and the Written Opinion of the International Searching Authority, or the Declaration; Sep. 8, 2009.

*Primary Examiner* — Joe Morano, IV
*Assistant Examiner* — Jason C Smith
(74) *Attorney, Agent, or Firm* — Eugene M. Cummings

(57) ABSTRACT

The present invention provides a joint for transferring load from the underframe of a locomotive to the cant rail of its car body. The joint includes a base connected to the underframe of the locomotive with a body portion attached thereto. This body portion carries a generally diagonally situated member connected to the cant rail of the car body of the locomotive, such that the load from the underframe is transferred to the base of the joint, through the body portion of the joint, to the diagonally situated member and to the cant rail during bending of the underframe of the locomotive. In another aspect of the present invention, a joint is provided which is generally flexible to accommodate bending of the car body and underframe of the locomotive relative to their respective stiffnesses.

12 Claims, 9 Drawing Sheets

U.S. PATENT DOCUMENTS

| | | | | |
|---|---|---|---|---|
| 6,962,114 | B1 * | 11/2005 | Forbes | 105/404 |
| 7,044,062 | B2 * | 5/2006 | Forbes | 105/355 |
| 7,108,467 | B2 * | 9/2006 | Forbes et al. | 410/32 |
| 7,249,562 | B2 * | 7/2007 | Forbes et al. | 105/355 |
| RE39,777 | E * | 8/2007 | Forbes et al. | 105/404 |
| 7,337,727 | B2 * | 3/2008 | Forbes | 105/404 |
| 7,424,854 | B2 * | 9/2008 | Forbes | 105/355 |
| 7,506,591 | B2 * | 3/2009 | Saxton et al. | 105/355 |
| 7,546,808 | B2 * | 6/2009 | Saxton et al. | 105/355 |
| 2009/0013900 | A1 * | 1/2009 | Scott et al. | 105/456 |

* cited by examiner

LOCOMOTIVE CAR BODY FLEXIBLE JOINT

BACKGROUND OF INVENTION

The present invention is directed to a joint for transferring load from the underframe of a locomotive to the cant rail of the locomotive's car body. The joint includes a base connected to the underframe of the locomotive with a body portion attached thereto. This body portion carries a generally diagonally situated member connected to the cant rail of the car body of the locomotive, such that some of the load from the underframe is transferred to the base of the joint, through the body portion of the joint, to the diagonally situated member and to the cant rail during bending of the underframe of the locomotive. In another aspect of the present invention, the joint may be generally flexible to accommodate bending of the car body and underframe of the locomotive relative to their respective stiffness.

FIG. 1 illustrates a traditional locomotive. The locomotive's car body 102 is generally fixed and welded to an underframe 100 at 106 and welded to a cab 104 at 108. The underframe 100 and cab 104 are also welded together at 110. In this traditional arrangement, the underframe 100 is generally heavy; it may be between about 70,000 and about 100,000 pounds and is generally about 90,000 pounds. Accordingly, any bending of the underframe 100 is generally minimal and gradual.

However, in the course of operation, the traditional locomotive's engine transfers vibrations to any connected structures. These vibrations cause the panels of the cab structure to vibrate and contribute to an increase in noise level within the cab. In order to reduce the noise level in the cab structure, the cab may be supported on isolators. Locomotives with isolated cabs are preferable because, in addition to limiting noise, they limit shock vibrations in the cab.

In contrast to the traditional locomotive, the bending of the underframe of a locomotive with an isolated cab is not gradual and, because the underframe is generally light and flexible (between about 40,000 and about 50,000 pounds, generally about 45,000 pounds), it is easily bent. In a locomotive having an isolated cab 204, as shown in FIG. 2, or any other locomotive having a generally lighter and more flexible underframe 200, the locomotive operational loads transfer from the underframe 200 structure to the car body 202. In this arrangement, the cab 204 is isolated from the underframe 200 and the car body 202 (i.e. there is no welding between the cab 204 and underframe 200 and there is no welding between the cab 204 and the car body 202). Instead, the cab 204 includes isolators 208 (e.g., bushings or the like) which limit shock vibration in the cab 204. In this arrangement, the underframe 200 and car body 202 are welded and form a weld joint, which causes the underframe 200 and car body 202 to rotate together. The point of rotation 212 is at the point where the car body 202 and the underframe 200 meet behind the cab 204. Since the welding of these two structures will lead to the same rotational value, their different stiffness values will lead to high stress concentrations at the connection between them. As shown in FIG. 3, the rotational value θ for the underframe 300 and car body 302 is the same, causing high stress at the point of rotation 312. Accordingly, the portion of the underframe 300*a* connected to the isolated cab will bend more than the portion of the underframe 300*b* welded to the car body 302, thereby causing high stress to the underframe 300 at the point of rotation 312. One example of an isolated cab system is described in U.S. patent application Ser. No. 11/943,261, entitled "Cab Isolation System for a Locomotive," the disclosure of which is incorporated by reference herein and made a part hereof.

Various attempts have been made to provide construction for a locomotive and underframe that provide the necessary strength and durability for the highly stressed portion of the car body. For example, a direct-bolted fastener has been used to attach the engine and generator directly to the underframe of the locomotive. Nevertheless, this arrangement has caused inordinate stresses in the engine bed and base structure, resulting at times in distortion, misalignment or deformation of the lower portions of the engine.

Therefore, in order to resolve the problem of force distribution, it is an aspect of the present invention to provide a joint to transfer some of the load from the underframe to the cant rail and transfer the remainder of load back through the underframe. In another aspect of the present invention, the joint may be generally flexible to enable the underframe and car body to rotate with different rotational values relative to their stiffness values. Since both structural components are allowed to rotate separately, the stress concentration problems have been resolved.

SUMMARY OF INVENTION

In accordance with the present invention, provided is a joint for transferring load from the underframe of a locomotive to the cant rail of its car body. The joint includes a base connected to the underframe of the locomotive with a body portion attached thereto. This body portion carries a generally diagonally situated member connected to the cant rail of the car body of the locomotive, such that some of the load is transferred from the underframe to the base of the joint, through the body portion of the joint, to the diagonally situated member and to the cant rail during bending of the underframe of the locomotive.

In another aspect of the present invention, provided is a method for transferring load from the underframe of a locomotive to a cant rail of a car body of the locomotive using a generally flexible joint. The generally flexible joint facilitates a generally angular transmission of some of the load from the underframe to the cant rail to accommodate bending of the underframe relative to its own stiffness and bending of the car body relative to its own stiffness.

DETAILED DESCRIPTION OF THE DRAWINGS

In an aspect of the present invention, a joint is provided for a locomotive, which allows transfer of some of the load from the locomotive's underframe to its cant rail when the underframe is bent. The joint is generally comprised of a base and a body portion. The base is connected to the body portion of the joint, which carries a generally diagonally situated member connected to the cant rail of the car body of the locomotive, such that some of the load is transferred from the underframe of the locomotive to the base of the joint, through the body portion of the joint, to the generally situated member, and to the cant rail during bending of the underframe of the locomotive. Additionally, the joint may include a top portion for carrying a generally vertical post, which is connected to the cant rail of the car body. This arrangement forms a generally C-shaped joint whereupon some of the load is transferred from the underframe of the locomotive to the base of the joint, through the body portion, to the top portion, to the generally vertical post, and to the cant rail during bending of the underframe.

Figure 1:
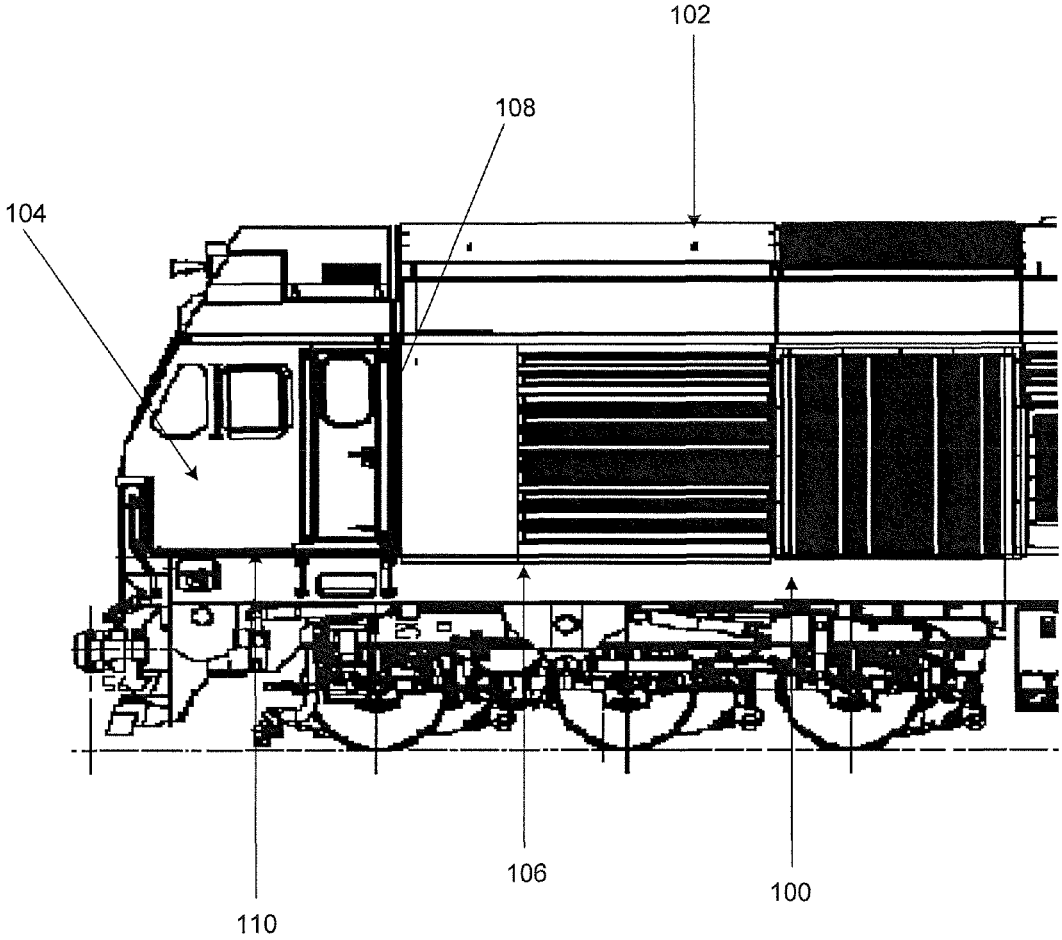
FIGURE 1 (PRIOR ART)
FIG. 1 is a side view of a traditional locomotive with a cab, car body and underframe welded together.
Figure 2:
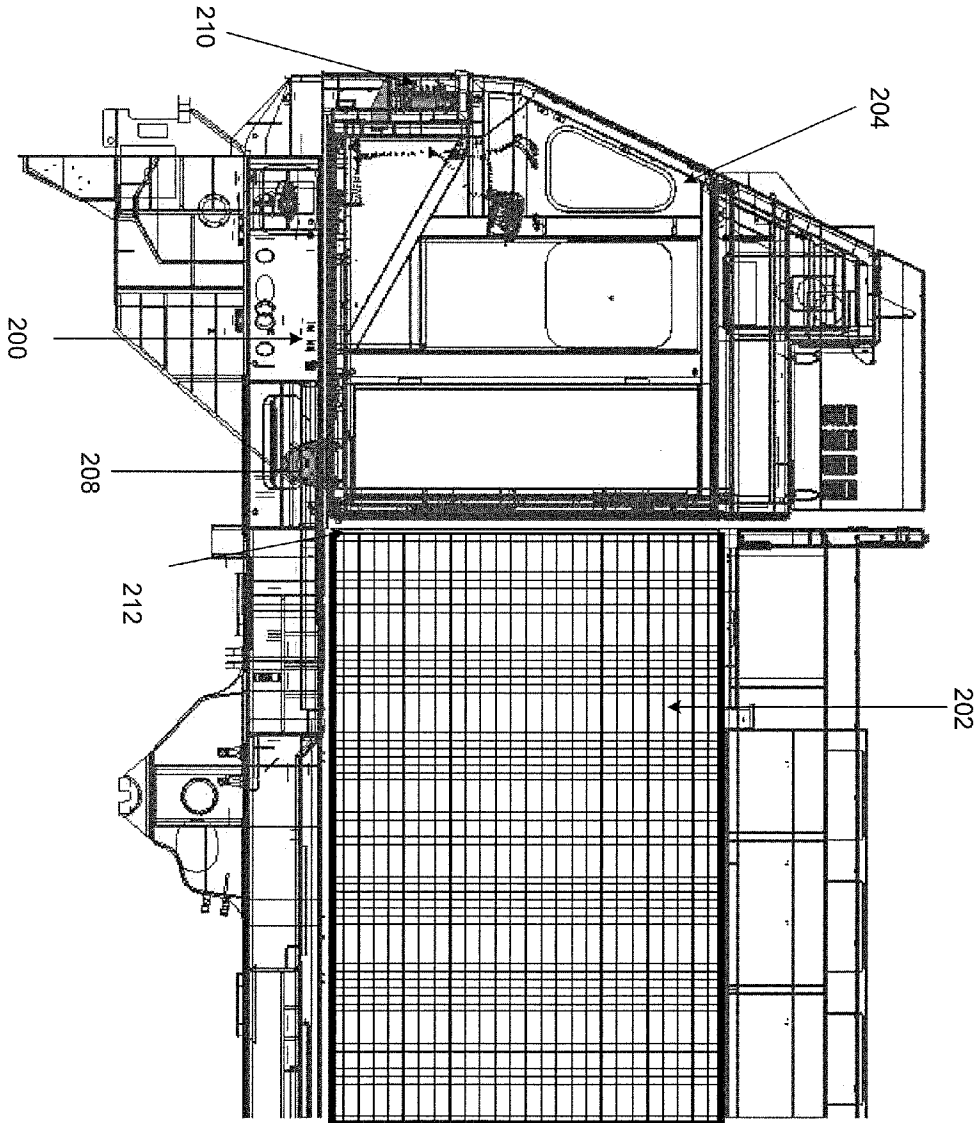
FIGURE 2 (PRIOR ART)
FIG. 2 is a side view of a traditional locomotive with an isolated cab.
Figure 3:
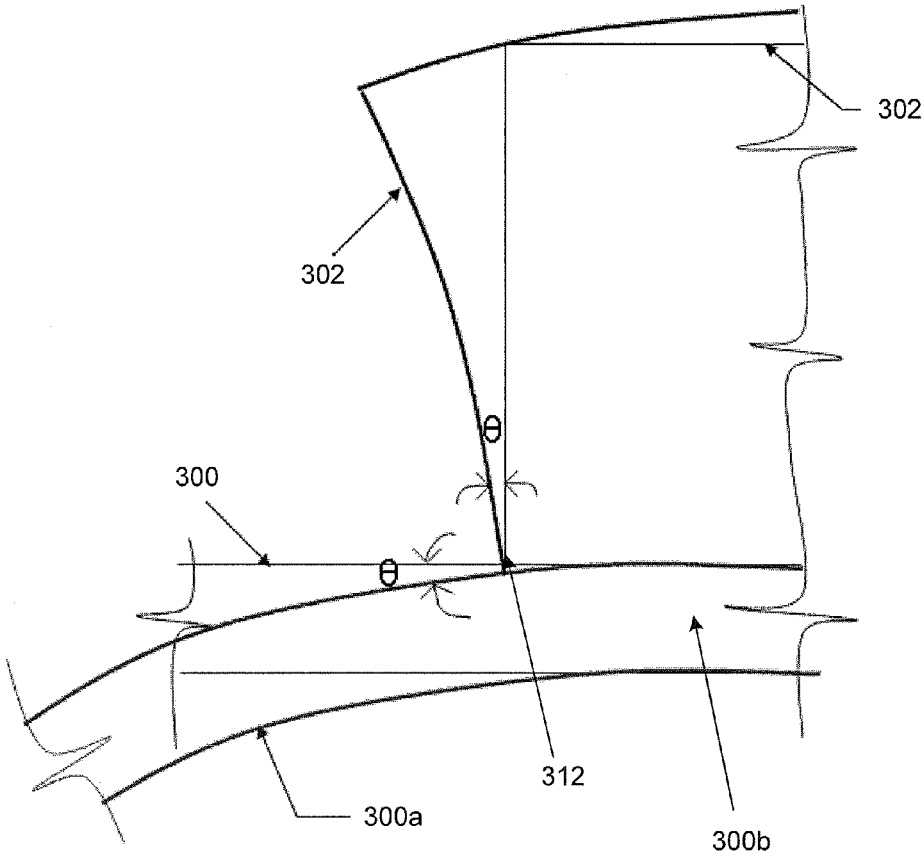
FIGURE 3 (PRIOR ART)
FIG. 3 is a conceptual drawing of the deformed shape due to locomotive operational loads in a traditional locomotive.
Figure 4:
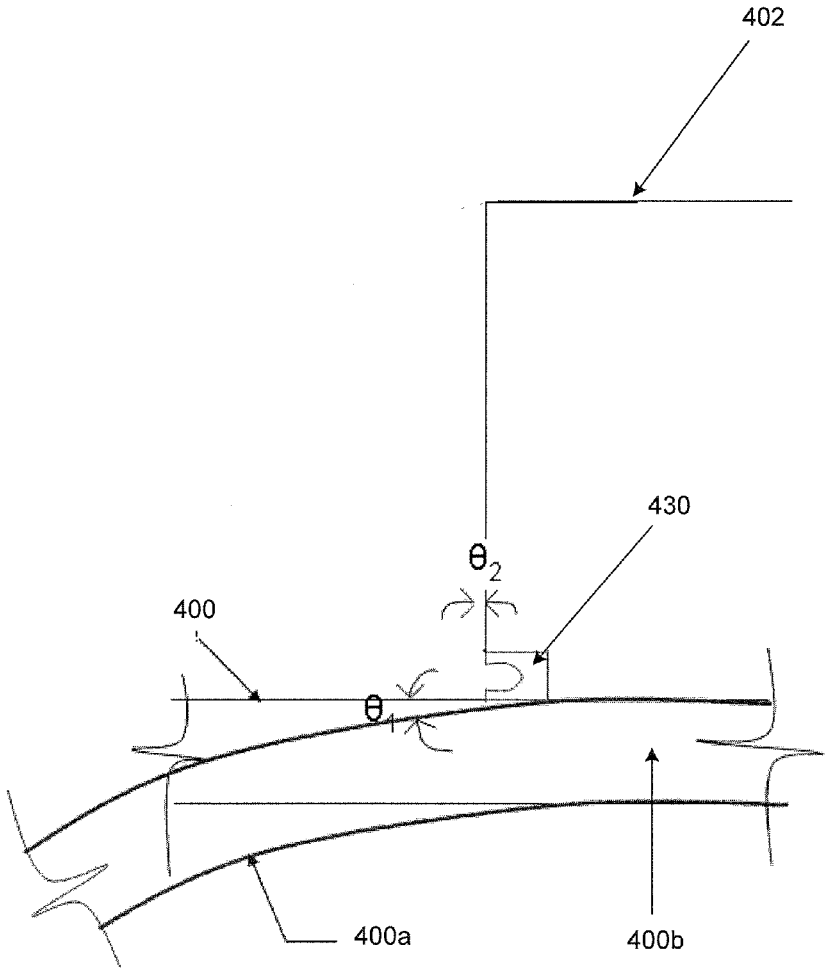
FIG. 4 is a conceptual drawing of a joint in accordance with the present invention.

FIG. 4 illustrates another aspect of the present invention, which provides a new way of joining the underframe 400 and car body 402 using a generally flexible joint 430. The joint 430 is generally flexible to enable the underframe 400 and car body 402 to rotate or bend at different rotational values, $\theta_1$ and $\theta_2$ respectively, relative to their stiffness values. For example, the underframe's rotational value $\theta_1$ may be proportional to the properties of the portion of the underframe 400*a* associated with the cab. The car body's rotational value $\theta_2$ may be proportional to the total properties of the portion of the underframe 400*b* associated with the car body 402 and the car body 402 together. Because the joint 430 is generally flexible, the portion of the underframe 400 associated with the locomotive cab is able to bend proportionally to its own stiffness at $\theta_1$, while the car body 402 is also able to bend proportionally to the total stiffness of the portion of the underframe 400 connected to the car body 402 and the stiffness of the car body 402 at $\theta_2$.

Figure 5:
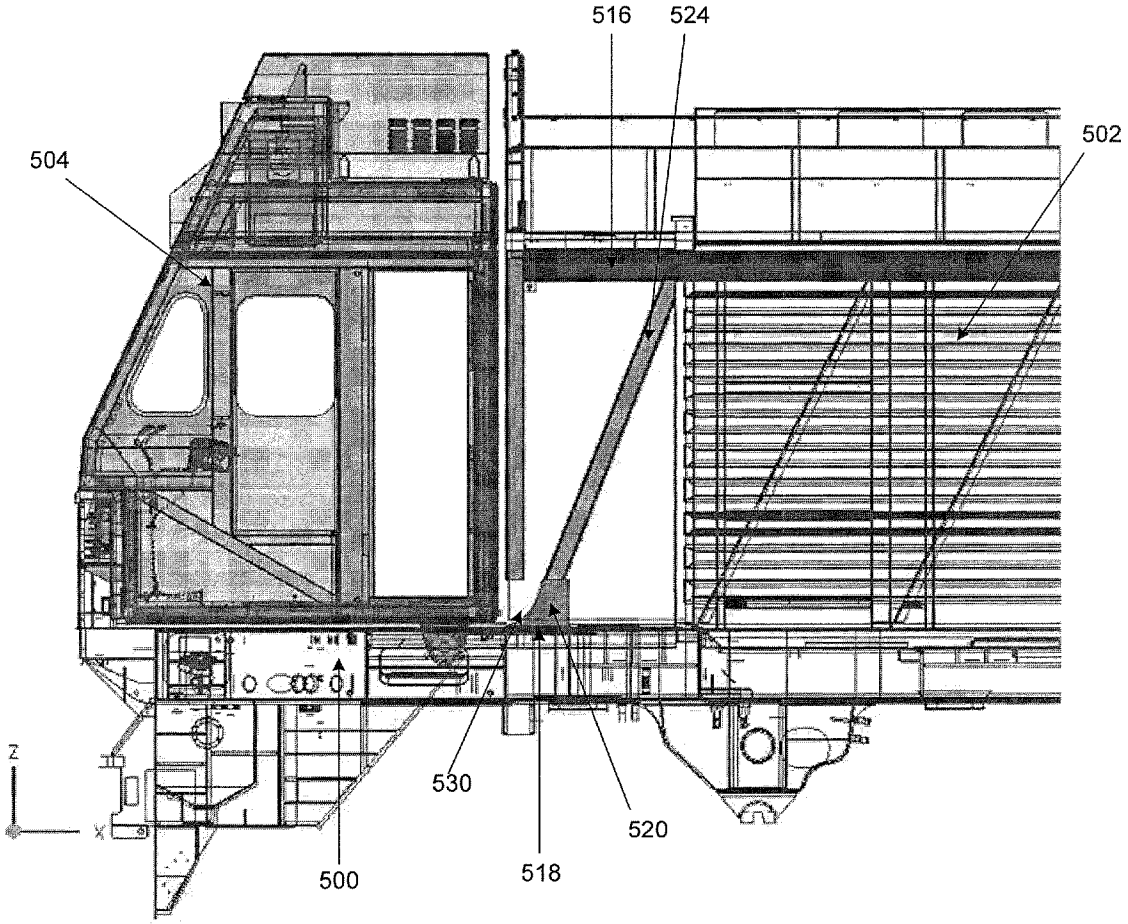
FIG. 5 is a side view of a first embodiment of the present invention showing an L-shaped joint.

In a first embodiment of the present invention joint, shown in FIG. 5, the base 518 and the body portion 520 together form a generally L-shaped joint 530. The body portion 520 carries a generally diagonally situated member 524, which is connected to the cant rail 516 of the car body 502. The generally diagonally situated member 524 may be attached to the body portion 520 at an angle between about 40° and about 75° via a bolt, welding or is otherwise similarly secured. During bending of the underframe 500 of the locomotive, at least some of the load is transferred from the underframe 500 of the locomotive to the base 518 of the joint 530 through the body portion 520 of the joint 530, to the diagonally situated member 524, and to the cant rail 516. The connection between the base 518 and body portion 520 of the joint 530 may be generally flexible to accommodate bending of the underframe 500 and car body 502 of the locomotive relative to their own stiffnesses, as described in FIG. 4.

Figure 6:
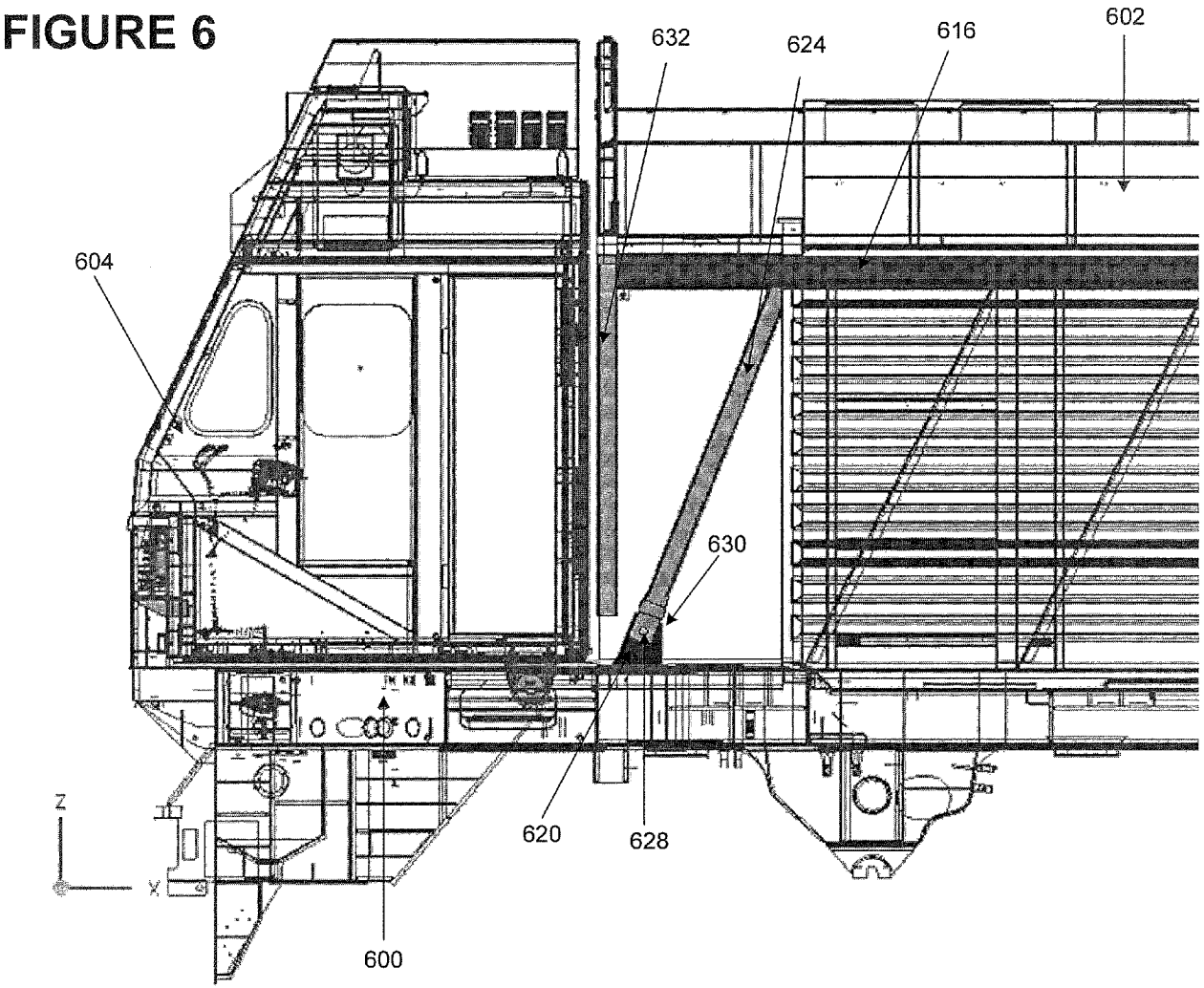
FIG. 6 is a side view of a second embodiment of the present invention showing a pin-joint.

FIG. 6 illustrates a second embodiment of the present invention where the joint includes a body portion 620 and a pin 628 for connecting a generally diagonally situated member 624 to the body portion 620, thereby forming a pin joint 630. The pin 628 may be secured to a generally diagonally situated member 624 at an angle between about 40° and about 75°, which is connected to the cant rail 616 of the locomotive. The pin 628 may be tightened or loosened to adjust the angle of the generally diagonally situated member 624. In this arrangement, some of the load is transferred from the underframe 600 of the locomotive to the pin joint 630, through the generally diagonally situated member 624, and to the cant rail 616. The structure of the pin joint 630 is not flexible; rather the pin joint 630 is able to have flexion by rotating about the pin 628. The pin 628 may be tightened or loosened to increase or decrease flexibility of the joint 630 accordingly. In this arrangement, the pin joint 630 accommodates bending of the underframe 600 and car body 602 of the locomotive relative to their own stiffnesses, as described in FIG. 4. Alternatively, the body 620 of the pin joint 630 may also be flexible to accommodate bending of the underframe 600 and car body 602 of the locomotive relative to their own stiffnesses, as described in FIG. 4.

In another arrangement of the embodiment described in FIG. 6 (not shown), the body of the pin joint may include a ledge for carrying a vertical post, such that the vertical post is bolted, welded or otherwise similarly secured to the joint. The vertical post may also be connected to the cant rail of the car body. Therefore, some of the load may be transferred from the underframe to the base of the joint, through the body portion, to the top portion, up through the generally vertical post, and to the cant rail.

Figure 7:
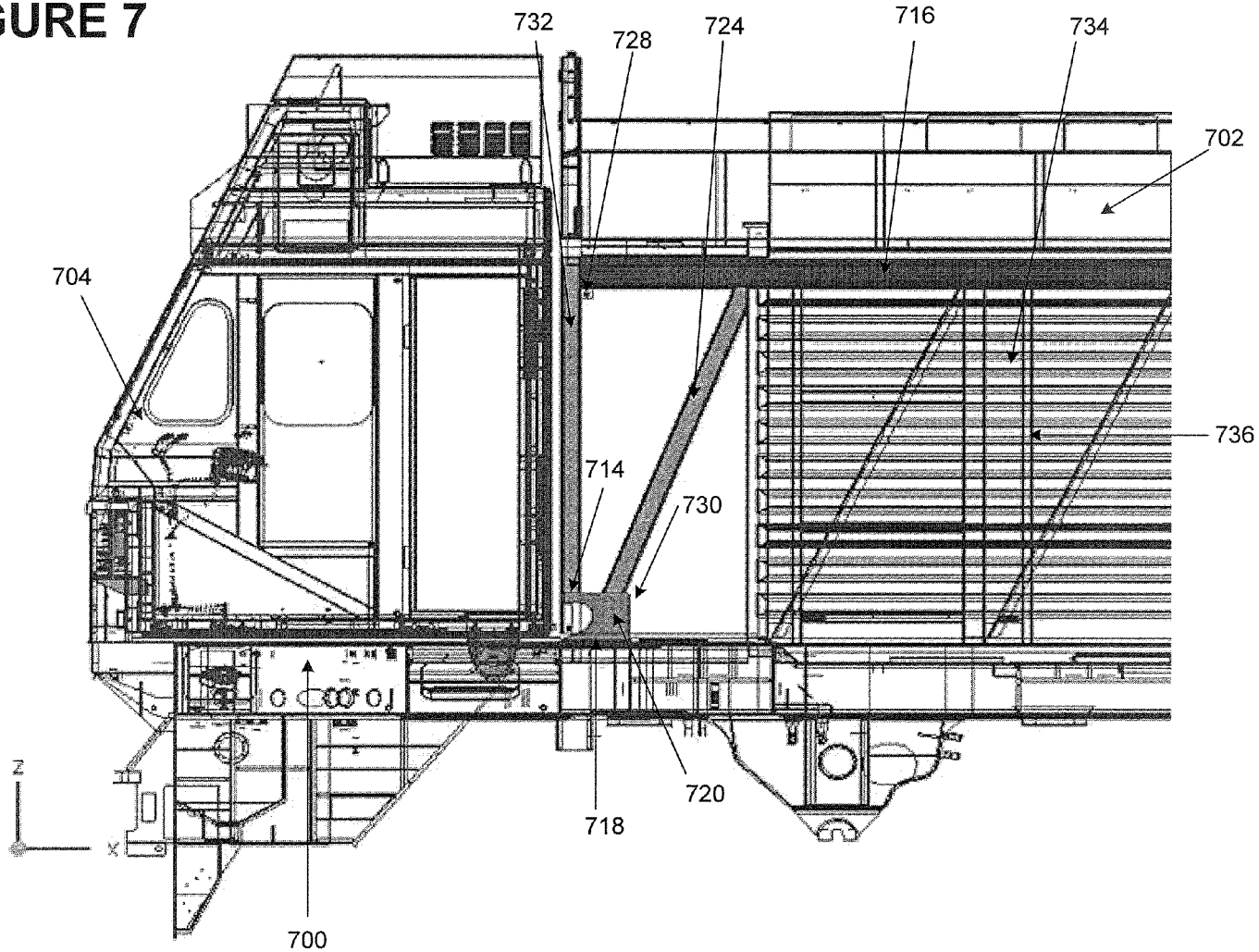
FIG. 7 is a side view of a third embodiment of the present invention showing a C-shaped joint.

In a third embodiment, illustrated in FIG. 7, a generally C-shaped joint 730 is provided, which includes a base 718, body portion 720 and top portion 714. The body portion 720 of the C-shaped joint 730 carries a generally diagonally situated member 724 at an angle selected between about 40° and about 75°, similar to the arrangements discussed above. Preferably, the C-shaped joint 730 in this embodiment carries a generally situated member 724 at an angle of about 68°. The C-shaped joint 730 further includes a top portion 714, which is bolted, welded or otherwise similarly secured to a generally vertical post 732, which is also connected to the cant rail 716 of the car body 702. The generally vertical post 732 may be connected to the skin 734 of the sideframe 736 of the car body 702 via a bolt 728. Although a section of the skin 734 is not shown relative to the bolt 728, or extending to the vertical post 732, the skin 734 nevertheless is intended to generally extend to the vertical post 732. The skin 734 is bolted to the vertical post 732 in order to allow adequate flexion for the joint 730. If the skin 734 were welded instead, it would inhibit the flexibility of the joint and too much weight would be placed on the underframe 700. The generally vertical post 732 is separate and apart from the cab 704 so that the cab 704 is isolated.

During bending of the underframe 700 of the locomotive, this arrangement allows some of the load to be transferred from the underframe 700 of the locomotive to the base 718 of the joint 730, through the body portion 720, up to the diagonally situated member 724, and to the cant rail 716 of the locomotive. Additionally, some of the load is transferred from the underframe 700 to the base 718 of the joint 730, through the body portion 720, to the top portion 714, up through the generally vertical post 732, and to the cant rail 716. The connection between the base 718 and body portion 720 of the joint 730 may be generally flexible to accommodate bending of the underframe 700 and car body 702 of the locomotive relative to their own stiffnesses, as described in FIG. 4.

Figure 8A:
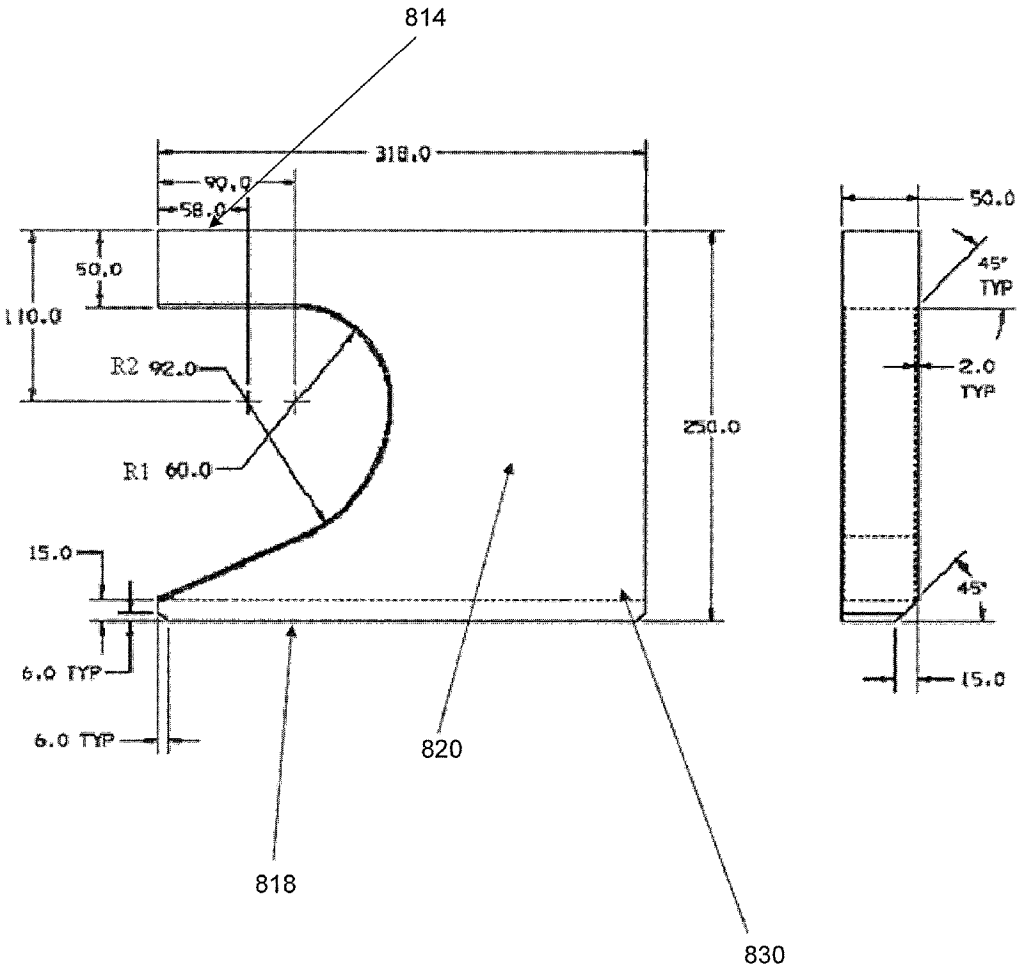
FIG. 8A is a side view of an embodiment of the C-shaped joint as shown in FIG. 7.
Figure 8B:
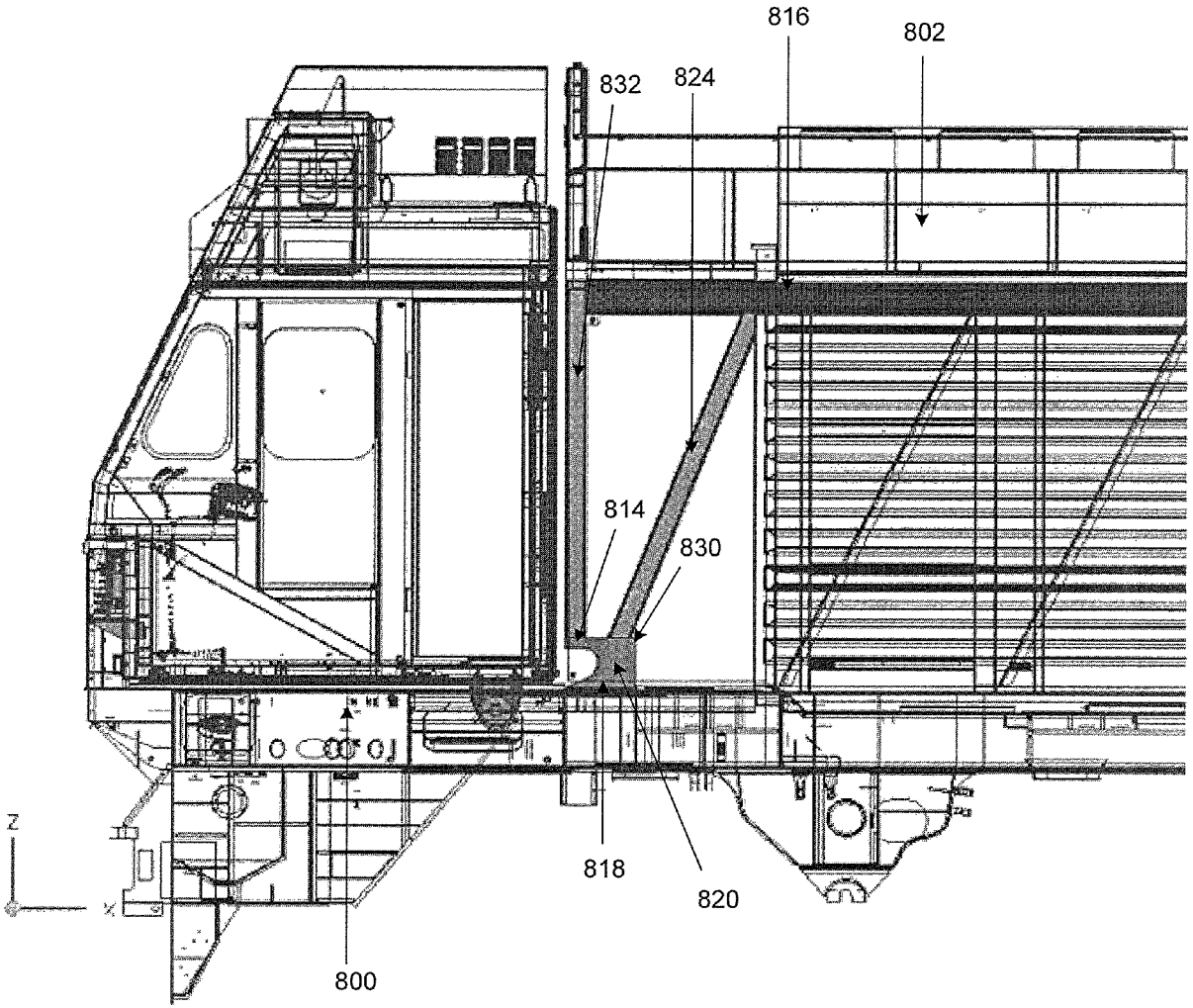
FIG. 8B is a perspective view of an embodiment of the C-shaped joint as shown in FIG. 7.

FIGS. 8A and 8B illustrate another embodiment of a C-shaped joint 830. The joint 830 may be about 250 mm in height by about 318 mm in length. The joint 830 may be about 50 mm wide. This joint 830 is comprised of a base 818 that is connected to the underframe 800 of the locomotive and a body portion 820. At the connection between the base 818 and the underframe 800, an angle selected between about 18° and about 28° is formed. Preferably, this angle is about 23°. The C-shape is comprised of two different radii. The first radius R1 is about 60 mm and the second radius R2 is about 92 mm. The top portion 814 may include a ledge having a thickness of about 50 mm and a length of about 90 mm. In this arrangement, the joint 830 is approximately 23.4 kg and may be constructed of a high strength, low alloy structural steel (e.g., ASTM A572, grade 50 or the like). This construction allows for the joint to be durable, yet generally flexible.

The arrangement of FIG. 8A may be used in a locomotive having a generally lighter and more flexible underframe 800 (generally about 45,000 pounds), as shown in FIG. 8B. Traditionally, where the underframe 800 was light and flexible, and therefore easily bent, great stress would be placed on the underframe 800 and car body 802. However, the C-shaped joint arrangement illustrated in FIGS. 8A and 8B allows some of the load to be transferred from the underframe 800 to the cant rail 816 of the car body 802. More specifically, in this arrangement, a body portion 820 of the joint 830 carries a generally diagonally situated member 824 at an angle of about 68°. The generally diagonally situated member 824 may be bolted, welded or otherwise similarly secured to the body portion 820 of the joint 830. During bending of the underframe 800, this arrangement allows for some of the load to be transferred from the underframe 800 to the base 818 of the joint 830, up through the body portion 820, to the generally diagonally situated member 824, and to the cant rail 816, thereby alleviating some of the stress placed on the underframe 800.

Additionally, the ledge of the top portion 814 of the joint 830 may be adapted to carry a generally vertical post 832, which may be bolted, welded or otherwise similarly secured to a generally vertical post 832, which is also connected to the cant rail 816 of the car body 802. The generally vertical post 832 may be connected to the skin of the sideframe of the car body via a bolt. The skin is bolted to the vertical post 832 in order to allow adequate flexion for the joint 830. During bending of the underframe 800, this arrangement allows for some of the load to be transferred from the underframe 800 to the base 818 of the joint, through the body portion 820, up to the top portion 814, up through the generally vertical post 832, and to the cant rail 816 of the car body 802. The connection between the base 818 and body portion 820 of the joint 830 may be generally flexible to accommodate bending of the underframe 800 and car body 802 of the locomotive relative to their own stiffnesses, as described in FIG. 4.

Embodiments of the present invention relate to a joint for a locomotive, and more specifically, to a joint designed to transfer load from the underframe of a locomotive to the cant rail of its car body. In another aspect of the present invention, the joint is generally flexible to accommodate bending of the car body and underframe of the locomotive relative to their respective stiffnesses. The above description is presented to enable one of ordinary skill in the art to make and use the invention and is provided in the context of a patent application and its requirements.

Modifications to the various embodiments and the generic principles and features described herein will be readily apparent to those skilled in the art. For example, although the various embodiments of FIGS. 5-8 illustrate a locomotive with an isolated cab positioned on isolators, the use of an isolated cab is not necessary for the present invention to be effective. The present invention arrangements are generally effective for any locomotive having an underframe which is generally light and flexible. Thus, the present invention is not intended to be limited to the embodiments shown, but is to be accorded the broadest scope consistent with the principles and features described herein.

What is claimed:

1. A joint for transferring load from an underframe of a locomotive to a cant rail of a car body of the locomotive, wherein a portion of the underframe of the locomotive carries an isolated cab and another portion of the underframe of the locomotive carries the car body, said car body being separate and apart from the isolated cab, and wherein the isolated cab causes the underframe to bend at a location between the isolated cab and the car body, the joint comprising:

a base connected to the underframe of the locomotive and situated between the isolated cab and the car body at the underframe bending location, and a body portion connected to the base for carrying a member connected to the cant rail of the car body of the locomotive, wherein the body portion forms an angle selected between about 18 degrees and about 28 degrees relative to the base and wherein the body portion provides adequate flexion in addition to the connection between the base and underframe to allow the body portion to bend relative to the underframe such that some of the load resulting from the underframe bending at the location between the isolated cab and the car body is transferred from the underframe of the locomotive to the base of the joint, through the body portion of the joint, to the member, and to the cant rail during bending of the underframe of the locomotive to accommodate bending of the portion of the underframe associated with the isolated cab to bend proportionally to its own stiffness and to allow bending of the car body to bend proportionally to the total stiffness of the portion of the underframe associated with the car body and the stiffness of the car body.

2. The joint of claim 1 wherein the body portion further comprises a pin for connecting the member to the joint thereby forming a pin joint.

3. The joint of claim 1 wherein the base and body portion form a generally L-shaped joint.

4. The joint of claim 1 further comprising a top portion for joining a generally vertically disposed post connected to the cant rail of the car body.

5. The joint of claim 4 wherein the base, body portion and top portion form a generally C-shaped joint.

6. The joint of claim 5 wherein the member is a diagonally situated member, and the C-shaped joint carries the diagonally situated member at an angle of about 68°.

7. The joint of claim 4 wherein the car body includes a sideframe and a skin attached thereto, wherein the generally vertically disposed post is connected to the skin.

8. The joint of claim 7 wherein the vertically disposed post is connected to the skin via a bolt.

9. The joint of claim 4 wherein the generally vertically disposed post is situated separate and apart from the cab.

10. The joint of claim 1 wherein the member is a diagonally situated member, and the body portion carries the diagonally situated member at an angle between about 40° and about 75°.

11. The joint of claim 1 wherein the member is a diagonally situated member, and the body portion carries the diagonally situated member at an angle of about 45°.

12. A joint for distributing load from an underframe of a locomotive to a car body of the locomotive, wherein a portion of the underframe of the locomotive carries an isolated cab and another portion of the underframe of the locomotive carries the car body, said car body being separate and apart from the isolated cab, and wherein the isolated cab causes the underframe to bends at a location between the isolated cab and the car body, the joint comprising:

a base connected to the underframe of the locomotive and situated between the isolated cab and the car body at the underframe bending location, a body portion generally connected to the base at one end, and a top portion generally connected to the body portion at another end and including a ledge, wherein the base, body portion and top portions form a generally flexible C-shape, wherein the base is connected to the body portion to form an angle selected between about 18 degrees and about 28 degrees relative to the base and forming a radius of about 92 mm, and wherein the body portion is generally connected to top portion to form a radius of about 60 mm, wherein the ledge carries at least one member connected to the car body of the locomotive, such that some of the load resulting from the underframe bending is distributed from the underframe of the locomotive to the base of the joint, through the body portion of the joint, through the top portion of the joint and to the car body, the body portion providing adequate flexion in addition to the connection between the base and underframe to accommodate bending of the portion of the underframe associated with the isolated cab to bend proportionally to its own stiffness and allowing the car body to bend proportionally to the total stiffness of the portion of the underframe associated with the car body and the stiffness of the car body.

* * * * *